US010669661B2

(12) United States Patent
Lee et al.

(10) Patent No.: US 10,669,661 B2
(45) Date of Patent: Jun. 2, 2020

(54) LAUNDRY TREATMENT APPARATUS

(71) Applicant: LG ELECTRONICS INC., Seoul (KR)

(72) Inventors: Jonghwan Lee, Seoul (KR); Junho Lee, Seoul (KR); Dongsoo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 231 days.

(21) Appl. No.: 14/814,556

(22) Filed: Jul. 31, 2015

(65) Prior Publication Data

US 2016/0032515 A1 Feb. 4, 2016

(30) Foreign Application Priority Data

Aug. 1, 2014 (KR) ..... 10-2014-0098831

(51) Int. Cl.

| | |
|---|---|
| ***D06F 23/04*** | (2006.01) |
| ***D06F 29/00*** | (2006.01) |
| ***D06F 17/08*** | (2006.01) |
| ***D06F 21/08*** | (2006.01) |
| ***D06F 31/00*** | (2006.01) |
| *D06F 39/10* | (2006.01) |
| *D06F 17/06* | (2006.01) |
| *D06F 37/12* | (2006.01) |

(52) U.S. Cl.

CPC ..... *D06F 23/04* (2013.01); *D06F 17/08* (2013.01); *D06F 21/08* (2013.01); *D06F 29/00* (2013.01); *D06F 31/00* (2013.01); *D06F 17/06* (2013.01); *D06F 37/12* (2013.01); *D06F 39/10* (2013.01)

(58) Field of Classification Search

CPC ..... D06F 31/00; D06F 29/00; D06F 21/06; D06F 21/08; D06F 21/14; D06F 23/04; D06F 17/08

See application file for complete search history.

(56) References Cited

U.S. PATENT DOCUMENTS

| | | | | |
|---|---|---|---|---|
| 1,451,803 A | | 4/1923 | Armstrong | |
| 2,645,111 A | * | 7/1953 | Fields | D06F 13/08 68/23.6 |

(Continued)

FOREIGN PATENT DOCUMENTS

| | | |
|---|---|---|
| CA | 2728921 | 11/2013 |
| CN | 1303449 | 7/2001 |

(Continued)

OTHER PUBLICATIONS

Machine translation of CN1303449A chinese equivalent of JP3833068B2, dated Oct. 2006.*

(Continued)

*Primary Examiner* — Joseph L. Perrin
*Assistant Examiner* — Kevin G Lee
(74) *Attorney, Agent, or Firm* — Fish & Richardson P.C.

(57) ABSTRACT

A laundry treatment apparatus for treating laundry includes a main washing device and a secondary washing device. The secondary washing device includes a tub configured to receive wash water, a drum rotatably provided in the tub and configured to receive laundry, and a pulsator rotatably provided in the drum and configured to be rotated by motion of one or both of the wash water and the laundry that are received in the drum.

19 Claims, 8 Drawing Sheets

(56) References Cited

U.S. PATENT DOCUMENTS

| | | | | |
|---|---|---|---|---|
| 4,474,038 | A * | 10/1984 | McMillan | D06F 37/30 68/208 |
| 4,622,708 | A * | 11/1986 | Gaelic | D06F 13/02 68/134 |
| 5,680,780 | A | 10/1997 | Kim et al. | |
| 5,878,600 | A * | 3/1999 | Yeo | D06F 17/06 68/134 |
| 6,202,451 | B1 * | 3/2001 | Park | D06F 37/40 68/133 |
| 8,215,136 | B2 | 7/2012 | Kim et al. | |
| 2002/0056293 | A1 | 5/2002 | Kin et al. | |
| 2003/0200774 | A1 | 10/2003 | Kim et al. | |
| 2010/0030720 | A1 | 2/2010 | Stephens | |
| 2010/0218563 | A1 | 9/2010 | Plata et al. | |
| 2010/0307200 | A1 * | 12/2010 | Jeong | D06F 31/00 68/13 R |
| 2011/0029687 | A1 | 2/2011 | Kirrmann et al. | |
| 2011/0047714 | A1 | 3/2011 | Kim et al. | |
| 2011/0062128 | A1 | 3/2011 | Kock et al. | |
| 2011/0094271 | A1 | 4/2011 | Seo et al. | |
| 2011/0296876 | A1 * | 12/2011 | Seo | D06F 17/10 68/133 |
| 2012/0234054 | A1 | 9/2012 | Kim et al. | |
| 2014/0196507 | A1 | 7/2014 | Lee et al. | |
| 2017/0073868 | A1 * | 3/2017 | Lv | D06F 17/10 |

FOREIGN PATENT DOCUMENTS

| | | | | |
|---|---|---|---|---|
| CN | 1451803 | | 10/2003 | |
| CN | 201162128 | | 12/2008 | |
| CN | 101348989 | | 1/2009 | |
| CN | 104321481 | | 1/2015 | |
| JP | H07-299277 | | 11/1995 | |
| JP | 3833068 | B2 * | 10/2006 | D06F 17/08 |
| WO | 2000/006819 | | 2/2000 | |
| WO | 2008/069607 | | 6/2008 | |

OTHER PUBLICATIONS

Machine translation of CN 1451803 A, dated Oct. 2003.*

Machine translation of CN 201162128 Y, dated Dec. 2008. (Year: 2008).*

Office Action issued in Canadian Application No. 2,898,942 dated Dec. 5, 2016, 3 pages.

Office Action issued in Chinese Application No. 201510452301.2 dated Jan. 4, 2017, 16 pages (with English translation).

Extended European Search Report issued in European Application No. 15178807.2 dated Oct. 28, 2015, 9 pages.

Notice of Acceptance issued in Australian Application No. 2015207944 dated Sep. 6, 2016, 2 pages.

India Office Action in Indian Appln. No. 842/KOL/2015, dated Dec. 21, 2018, 7 pages.

Brazilian Office Action in Brazilian Application No. 1020150181469, dated Nov. 26, 2019, 7 pages.

* cited by examiner

LAUNDRY TREATMENT APPARATUS

This application claims the benefit of Korean Patent Application No. 10-2014-0098831, filed on Aug. 1, 2014, which is hereby incorporated by reference as if fully set forth herein.

FIELD

The present disclosure relates to a laundry treatment apparatus, and more particularly, to a laundry treatment apparatus including a main washing device and a secondary washing device that is additionally provided in the main washing device, so as to treat laundry.

BACKGROUND

In general, laundry treatment apparatuses are appliances for washing laundry using, for example, detergent and mechanical friction.

Typical laundry treatment apparatuses may be directly installed on the floor. However, a front-loading type laundry treatment apparatus (referred to as a "drum washing machine"), which is one of such laundry treatment apparatuses that is configured to load laundry from the front, may have a relatively low insert port for inserting the laundry. For this reason, a user may have to bend his/her body when loading or unloading laundry through the insert port.

In some cases, a support may be added beneath the front-loading type laundry treatment apparatus such that the laundry treatment apparatus is positioned vertically higher. In some cases, an additional, secondary washing device may be installed in the support and may be used to wash, for example, a small quantity of laundry.

SUMMARY

According to one aspect, a laundry treatment apparatus for treating laundry includes a main washing device and a secondary washing device, wherein the secondary washing device includes a tub configured to receive wash water, a drum rotatably provided in the tub and configured to receive laundry, and a pulsator rotatably provided in the drum and configured to be rotated by motion of one or both of the wash water and the laundry that are received in the drum.

Implementations according to this aspect may include one or more of the following features. For example, the secondary washing device may further include a motor configured to rotate the drum, and the pulsator may be configured to, based on the drum being rotated by the motor, rotate in the same direction as a rotation direction of the drum. In some cases, the pulsator may be configured to, based on the rotation of the drum stopping after a period of rotation, continue rotating in the same direction as the previous rotation direction of the drum for a predetermined time due to inertia.

In some examples, the secondary washing device may further include a motor configured to rotate the drum, and a pulsator connector may be installed between a shaft of the motor and the pulsator, the pulsator connector being configured to transfer a driving force of the motor to the drum without transferring the driving force to the pulsator. In these examples, the shaft of the motor may be coupled to a hub and configured to transfer the driving force of the motor to the drum, the pulsator connector may be installed to the hub and configured to rotate together with the hub, the pulsator may be restricted from vertically moving in the drum, and the pulsator may be engaged with the pulsator connector and configured to rotate about a circumference of the pulsator connector. In some cases, the pulsator may define a connection hole in a central portion of the pulsator, a stepped portion being formed on an inner peripheral surface of the connection hole, and the pulsator connector may include a vertical protrusion portion that forms a rotary shaft of the pulsator, a latch portion being engaged with the stepped portion to restrict vertical movement of the pulsator. The stepped portion may be configured such that the inner peripheral surface of the connection hole has a decreasing diameter toward a center of the connection hole. The latch portion may be fastened to an upper surface of the stepped portion, and a predetermined gap may be defined between the latch portion and the upper surface of the stepped portion. The latch portion may be configured as one or more latch portions provided along the inner peripheral surface of the connection hole. In some cases, a mesh cap may be provided at an upper side of the connection hole, and the mesh cap may define a plurality of holes having a predetermined size, the plurality of holes being configured to perform a filtering function.

In some implementations, the pulsator may include a body rotatably provided on a bottom surface of the drum, and one or more blades protruding upward from the body. In some cases, the blades may extend outward from a center of the body, and the body and blades of the pulsator may be integrated with each other. The secondary washing device may be a drawer type washing device configured to be inserted in and withdrawn from the laundry treatment apparatus. In some cases, the laundry treatment apparatus according to this aspect may further include a first cabinet defining an external appearance of the main washing device and a second cabinet defining an external appearance of the secondary washing device. The first and second cabinets may be integrated with each other.

DETAILED DESCRIPTION

Figure 1:
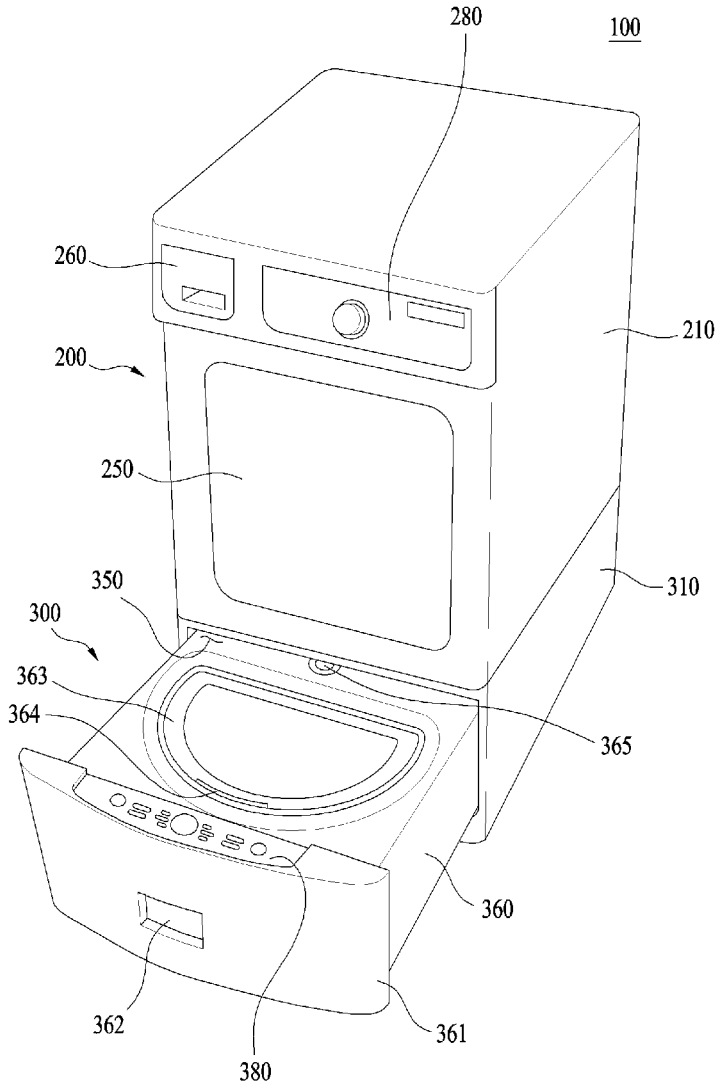
FIG. 1 is a perspective view illustrating an example laundry treatment apparatus.
Figure 2:
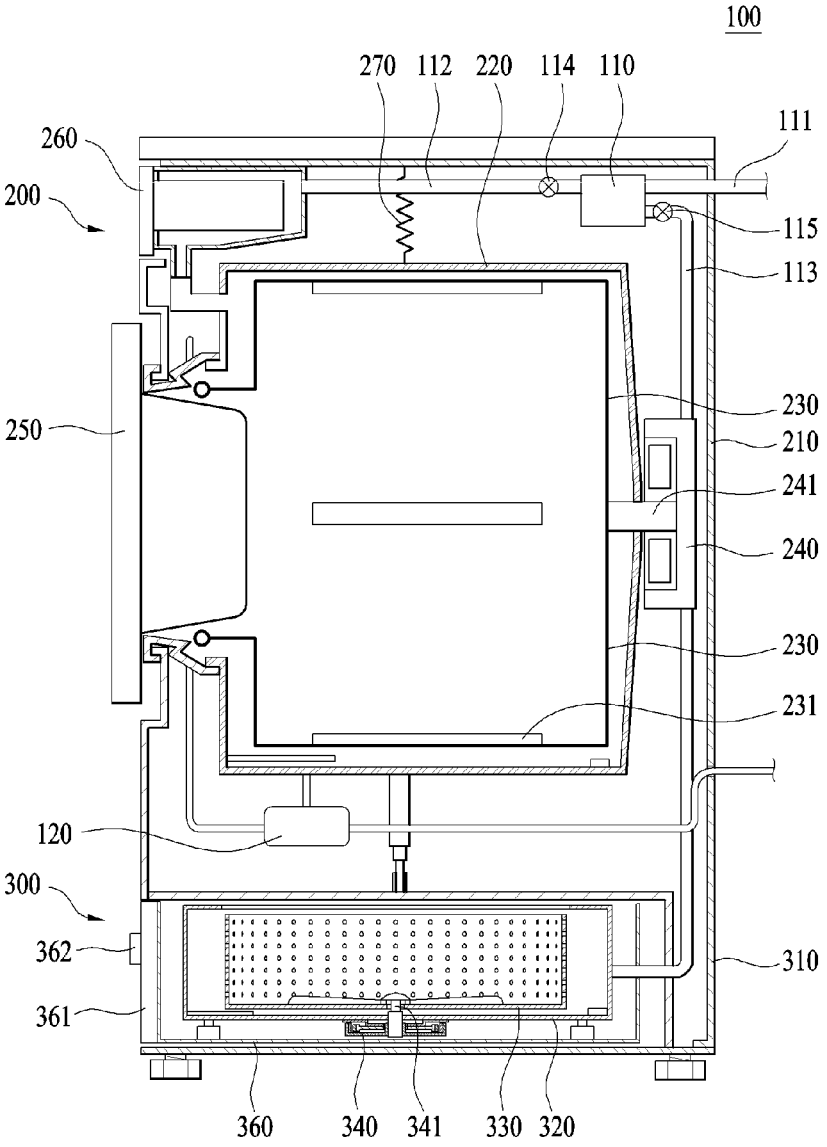
FIG. 2 is a cross-sectional view schematically illustrating the example laundry treatment apparatus shown in FIG. 1.

FIGS. 1 and 2 show an example laundry treatment apparatus according to an implementation of the present disclosure.

Referring to FIGS. 1 and 2, the laundry treatment apparatus, which is designated by reference numeral 100, may include a main washing device 200 and a secondary washing device 300. The secondary washing device 300 may be provided to one side of or beneath the main washing device 200. In addition, the main washing device 200 may include a first cabinet 210 defining the external appearance thereof, and the secondary washing device 300 may include a second cabinet 310 defining the external appearance thereof. In some cases, the first and second cabinets 210 and 310 may be integrally formed. In some cases, the laundry treatment apparatus 100 according to the implementation of the present disclosure may be configured of only the main washing device 200 or may be configured of only the secondary washing device 300.

The main washing device 200 may be a front-loading type washing device. In this case, a door 250 is installed at the front of the main washing device 200, and laundry may be inserted into the main washing device through the door 250.

Specifically, the main washing device 200 may include a first cabinet 210 defining the external appearance thereof, a first tub 220 which is provided in the first cabinet 210 to store wash water, and a first drum 230 which is rotatably arranged in the first tub 220 to receive laundry. The first drum 230 may be rotated by a first motor 240 provided outside the first tub 220 in the first cabinet 210. For instance, a first shaft 241 of the first motor 240 may be connected to the rear surface of the first drum 230 through the rear surface of the first tub 220. Accordingly, the driving force of the first motor 240 may be transferred to the first drum 230 through the first shaft 241.

In addition, one or more lifters 231 may be installed on the inner peripheral surface of the first drum 230 in order to tumble the laundry accommodated in the first drum 230. In addition, the first cabinet 210 may include a water supply section 110 for supplying wash water to the first tub 220 and a second tub 320 of the secondary washing device 300, which will be described later, a drainage section 120 for discharging the wash water from the first and second tubs 220 and 320 after washing is completed, and the like.

The water supply section 110 may include a water supply pump and a water supply pipe, and the drainage section 120 may have a drainage pump and a drainage pipe. In addition, the water supply section 110 may be connected to a supply line 111 through which wash water is supplied from an external water source of the laundry treatment apparatus. The wash water supplied to the water supply section 110 may be supplied to the first tub 220 via a detergent container 260 along a first line 112, or may be selectively supplied to the second tub 320 of the secondary washing device 300 along a second line 113. In order to selectively supply the wash water to the first and second tubs 220 and 320, first and second valves 114 and 115 may be provided on the first and second lines 112 and 113, respectively. For instance, the first valve 114 may open and close the first line 112, and the second valve 115 may open and close the second line 113.

In some cases, one or more dampers 270 may be installed between the first cabinet 210 and the first tub 220 in order to absorb vibration transferred to the first tub 220 by the rotation of the first drum 230. In addition, a damper (e.g. a cylinder damper) may be installed between the first tub 220 and the cabinet of the secondary washing device 300. In this case, each of the dampers 270 may be a spring damper or a cylinder damper. In addition, a control panel 280 for operating the main washing device 200 may be provided at the front upper side of the first cabinet 210.

The secondary washing device 300 may be arranged adjacent to the main washing device 200. For example, the secondary washing device 300 may be provided beneath the main washing device 200, to thereby improve the convenience of a user utilizing the main washing device 200. That is, the secondary washing device 300 may improve convenience for the user utilizing the main washing device 200 by allowing the main washing device 200 to be installed at a high position.

In some cases, when the secondary washing device 300 is provided together with the main washing device 200 to wash laundry, the main and secondary washing devices 200 and 300 may have the same washing capacity. Alternatively, one of the main and secondary washing devices 200 and 300 may have a lower capacity than the other, in consideration of the installation space and manufacturing costs of the laundry treatment apparatus 100.

As illustrated in FIGS. 1 and 2, the secondary washing device 300 may be configured such that at least one of a washing capacity, a volume, and a height is lower than that of the main washing device 200 in the implementation. Consequently, the user may appropriately select and use one of the main and secondary washing devices 200 and 300 according to the amount of laundry.

The user may select and use one of the main and secondary washing devices 200 and 300 according to the type of laundry. For example, laundry such as baby's clothing or underwear, which needs to be separated for washing, or small amounts of laundry may be washed using the secondary washing device 300, while other types of laundry may be washed using the main washing device 200.

As illustrated, the secondary washing device 300 may be a top-loading type washing device. Alternatively, the secondary washing device 300 may be a drawer type washing device, the components of which are inserted into or withdrawn from the second cabinet 310. For example, the secondary washing device 300 may include a second cabinet 310 defining the external appearance thereof, a drawer housing 360 which is inserted into or withdrawn from the second cabinet 310, a second tub 320 which is provided in the drawer housing 360 to store wash water, and a second drum 330 which is rotatably arranged in the second tub 320 to accommodate laundry. In addition, a drainage section for discharging the wash water may be provided at one side of the second tub 320.

The drawer housing 360 may be inserted into or withdrawn from the second cabinet 310 through an opening portion 350 formed in the second cabinet 310 toward the front of the laundry treatment apparatus 100.

The second drum 330 may be rotated by a second motor 340 provided outside the second tub 320 in the drawer housing 360. That is, a second shaft 341 of the second motor 340 may be connected to the rear surface of the second drum 330 through the rear surface of the second tub 320. Accordingly, the driving force of the second motor 340 may be transferred to the second drum 330 through the second shaft 341.

In some cases, a cover panel 361 may be installed at the front of the drawer housing 360. The cover panel 361 may be formed integrally with the drawer housing 360. In addition, the cover panel 361 may be formed with a handle 362 for inserting and withdrawing the drawer housing 360. A control panel 380 for operating the secondary washing device 300 may be provided on the upper surface of the cover panel 361. In addition, a supply hole 365, through which wash water is supplied to the second tub 320, and a door 363, through which laundry is inserted into or removed from the second drum 330, may be formed in the upper portion of the drawer housing 360.

Figure 3:
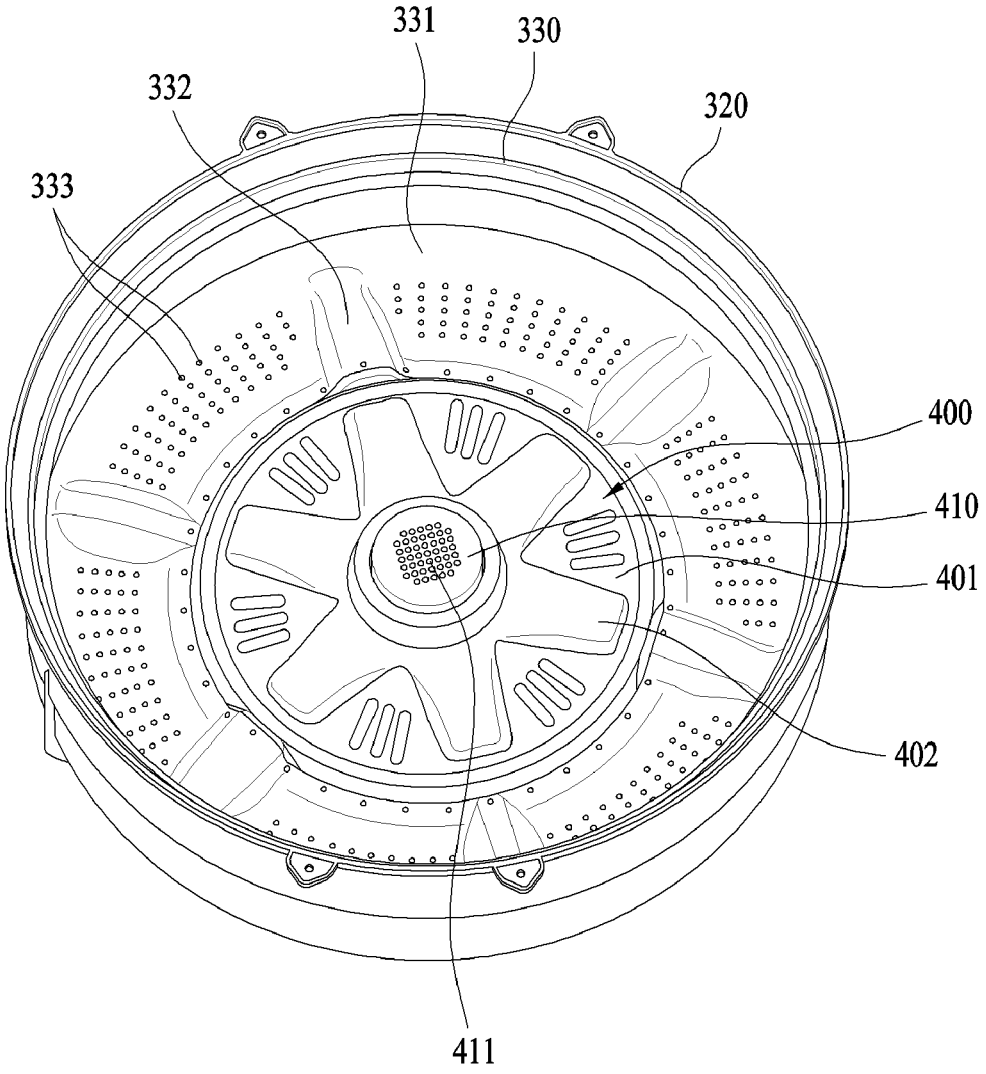
FIG. 3 is a perspective view illustrating an example secondary washing device of the laundry treatment apparatus.

Referring to FIG. 3, the secondary washing device 300 may include a pulsator 400 which is rotatably provided at the central portion of the second drum 300, in addition to the drawer housing 360, the second tub 320 provided in the drawer housing 360, and the second drum 330 rotatably arranged inside the second tub 320, which are described above. In addition, a mesh cap 410 for filtering out foreign substances such as lint, which may be contained in wash water, may be installed at the central portion of the pulsator 400. A plurality of holes 411 having a predetermined size may be formed in the mesh cap 410, and the mesh cap 410 may be fixed to the pulsator 400 so as to rotate along with the rotation of the pulsator 400.

In addition, one or more drum blades 332 may be provided at a base 331 of the second drum 330. That is, the drum blades 332 may protrude upward from the base 331 of the second drum 330. In some cases, the drum blades 332 formed at the base 331 of the second drum 330 may extend toward the outer periphery of the second drum 330. A plurality of drum blades 332 may be spaced apart by a predetermined distance (i.e. a predetermined angular distance) at the base 331 of the second drum 330. Thus, when the second drum 330 rotates, the drum blades 332 may generate a vortex of wash water in the second drum 330 so as to prevent laundry from tangling and improve washing efficiency.

In some cases, a plurality of holes 333 may be formed in the base 331 of the second drum 330. Through the holes 333 formed in the base 331, the wash water accommodated in the second tub 320 may flow into the second drum 330 or the wash water in the second drum 330 may flow out to the second tub 320. In some cases, a plurality of holes may be defined in the side of the second drum 330.

The pulsator 400 may include a pulsator body 401 and one or more pulsator blades 402. A plurality of pulsator blades 402 may protrude upward from the pulsator body 401, and may be spaced apart by a predetermined distance. In addition, the pulsator blades 402 may extend toward the outer periphery of the pulsator body 401. Thus, when the pulsator 400 rotates, the pulsator blades 402 may generate a vortex of wash water in the second drum 330 so as to prevent laundry from tangling and improve washing efficiency.

The pulsator 400, which will be specifically described later, may operatively rotate due to friction with at least one of wash water and laundry, which are accommodated in the second drum 330 to rotate along with the rotation of the second drum 330. In other words, the motion of one or both of wash water and laundry can cause the pulsator 400 to rotate.

Figure 4:
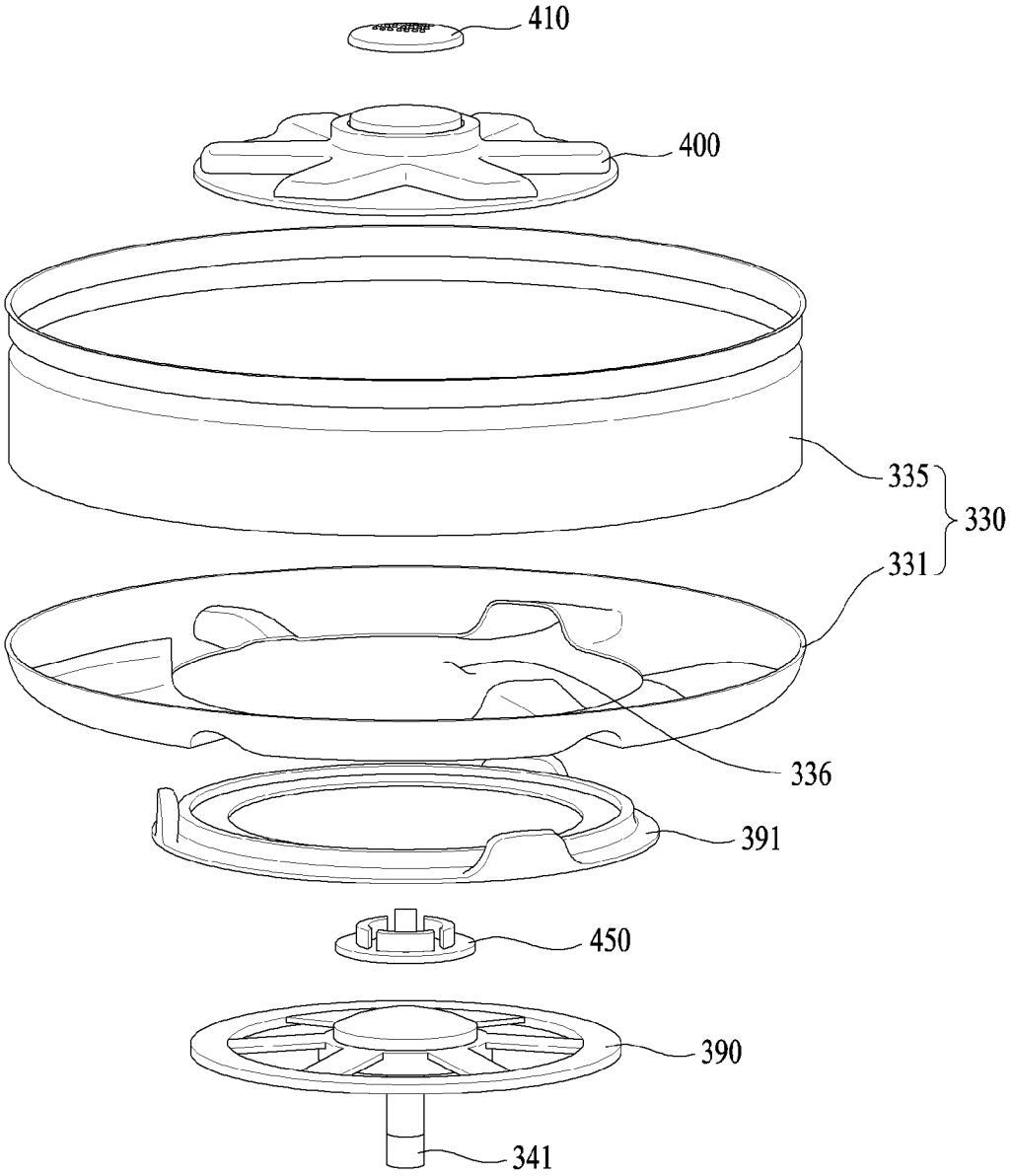
FIG. 4 is an exploded perspective view of the example secondary washing device illustrated in FIG. 3.

Referring now to FIGS. 2 and 4, the second drum 330 may include a drum body 335 and a drum base 331 coupled to the lower side of the drum body 335. In addition, the driving force (i.e. rotational force) of the second motor 340 may be transferred to the second drum 330 through the second shaft 341. As illustrated, a hub 390 is coupled to the upper side of the second shaft 341, and a connection flange 391 is installed between the drum base 331 and the hub 390. Accordingly, the driving force of the second motor 340 may be transferred to the drum base 331 through the second shaft 341, the hub 390, and the connection flange 391. As a result, the second drum 330 can be rotated.

The drum base 331 may have an opening portion 336 which is defined in the central portion thereof for installation of the pulsator 400 therethrough. In addition, a pulsator connector 450 may be installed to the hub 390. That is, the pulsator connector 450 may be installed at the upper central portion of the hub 390, and the pulsator connector 450 may also rotate along with the rotation of the hub 390.

For example, the pulsator 400 can be engaged with the pulsator connector 450, which is installed to the upper side of the hub 390, through the opening portion 336 formed in the drum base 331 of the second drum 330. In this case, although the hub 390 and the pulsator connector 450 may be rotated by the driving of the second motor 340, the pulsator 400 is engaged with the pulsator connector 450 such that the driving force of the second motor 340 is not transferred to the pulsator 400. The pulsator connector 450 may be engaged with the pulsator 400 so as to restrict only the vertical movement of the pulsator 400. That is, the pulsator 400 may circumferentially rotate about the pulsator connector 450 even though the pulsator connector 450 is engaged with the pulsator 400.

For example, when the second drum 330 is rotated by the second motor 340, the pulsator 400 may rotate in the same direction as the rotation direction of the second drum 330 due to friction with at least one of wash water and laundry which rotate in the second drum 330 in the same direction as the rotation direction of the second drum 330. In addition, when the rotation of the second drum is stopped following a period of rotation, the pulsator 400, which rotates in the same direction as the rotation direction of the second drum 330, may continue to rotate in the same direction as the rotation direction of the second drum 330 for a predetermined time due to inertia. That is, the pulsator connector 450 may be installed between the second shaft 341 of the second motor 340 and the pulsator 400 such that the driving force of the second motor 340 is transferred only to the second drum 330 through the second shaft 341, the hub 390, and the connection flange 391.

Figure 5:
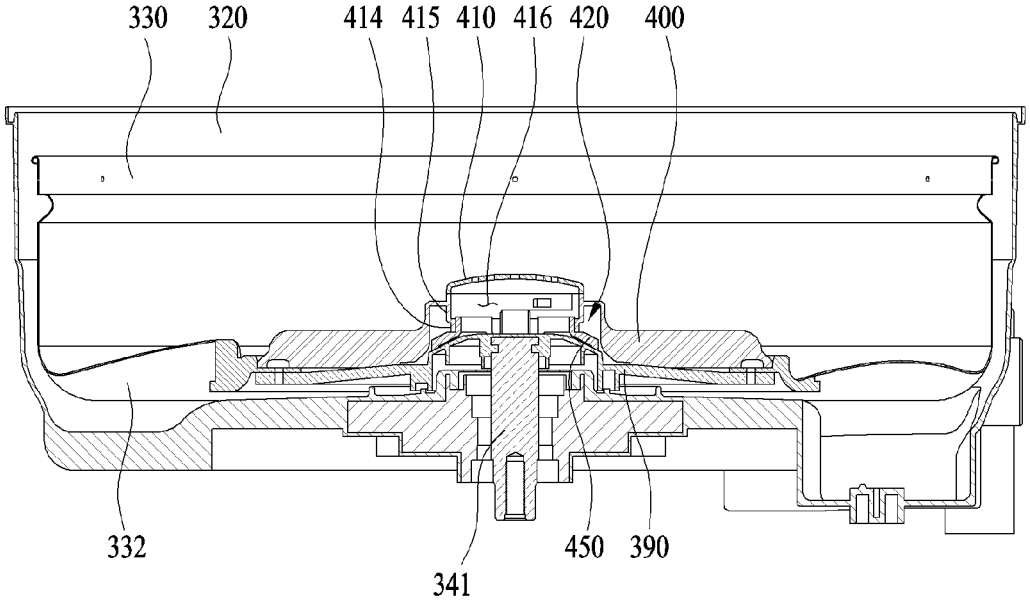
FIG. 5 is a transverse cross-sectional view of the example secondary washing device illustrated in FIG. 3.
Figure 6:
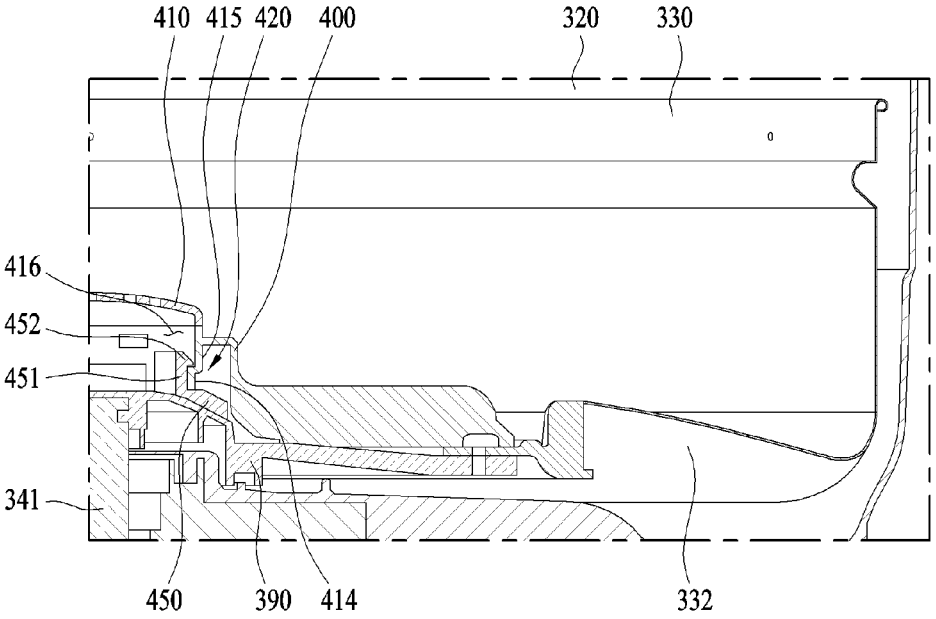
FIG. 6 is an enlarged cross-sectional view of the example secondary washing device illustrated in FIG. 5.

Referring to FIGS. 5 and 6, one side of the second shaft 341, to which the driving force of the second motor is transferred, may be connected the hub 390. In addition, the pulsator connector 450 may be connected to the upper side of the hub 390. Accordingly, when the second motor rotates, the hub 390 and the pulsator 400 can rotate together in the same direction as the rotation direction of the second motor. As described above, the driving force of the second motor may be, of course, transferred to the second drum 330 through the connection flange 391 arranged between the drum base 331 and the hub 390.

In this case, the pulsator 400 may be provided with a connection hole 416. Specifically, the connection hole 416 may be formed in the central portion of the pulsator 400. For example, the connection hole 416 may be formed in the central portion of the pulsator body 401 so as to vertically penetrate the pulsator 400, and one or more pulsator blades 402 may extend toward the outer periphery of the pulsator body 401 from the connection hole 416. When the pulsator connector 450 is coupled to the pulsator 400, at least a portion of the pulsator connector 450 may be inserted into the connection hole 416.

A stepped portion 420 may be formed on the inner peripheral surface of the connection hole 416 formed in the pulsator 400. In addition, the pulsator connector 450 may has a vertical protrusion portion 451 which forms the rotary shaft of the pulsator 400, and a latch portion 452 which is engaged with the stepped portion 420. Specifically, the latch portion 452 of the pulsator connector 450 may serve to restrict the vertical movement of the pulsator 400. For example, the latch portion 452 may protrude toward the inner peripheral surface of the connection hole 416 formed in the pulsator 400. Specifically, the latch portion 452 may protrude upward from the upper surface of the stepped portion 420.

In this case, a predetermined gap may be defined between the vertical protrusion portion 451 of the pulsator connector 450 and the inner peripheral surface of the stepped portion 420. In addition, a predetermined gap may be defined between the latch portion 452 and the upper surface of the stepped portion 420. This enables the pulsator 400 to freely rotate about the pulsator connector 450 while the rotation of the pulsator connector 450 is not transferred to the pulsator 400.

Thus, the driving force of the second motor 340 can be transferred to the pulsator connector 450 through the second shaft 341 and the hub 390, but not transferred to the pulsator 400. That is, since the predetermined gap is defined between the vertical protrusion portion 451 of the pulsator connector 450 and the inner peripheral surface of the stepped portion 420, the rotation of the pulsator connector 450 may not be transferred to the pulsator 400. For example, the pulsator connector 450 restricts the vertical movement of the pulsator 400, whereas it does not restrict the circumferential rotation of the pulsator 400.

That is, since the circumferential rotation of the pulsator 400 is not restricted by the pulsator connector 450, the pulsator 400 may rotate due to friction with at least one of wash water and laundry accommodated in the second drum 330. In addition, the pulsator 400, which begins to rotate due to friction with at least one of wash water and the laundry, may continue to rotate in the same direction for a predetermined time due to inertia even though the rotation of the second drum 330 is stopped.

In some cases, the mesh cap 410 may be installed to the upper side of the connection hole 416, and the holes 411 having the predetermined size may be formed in the mesh cap 410 so as to perform a filtering function.

Figure 7A:
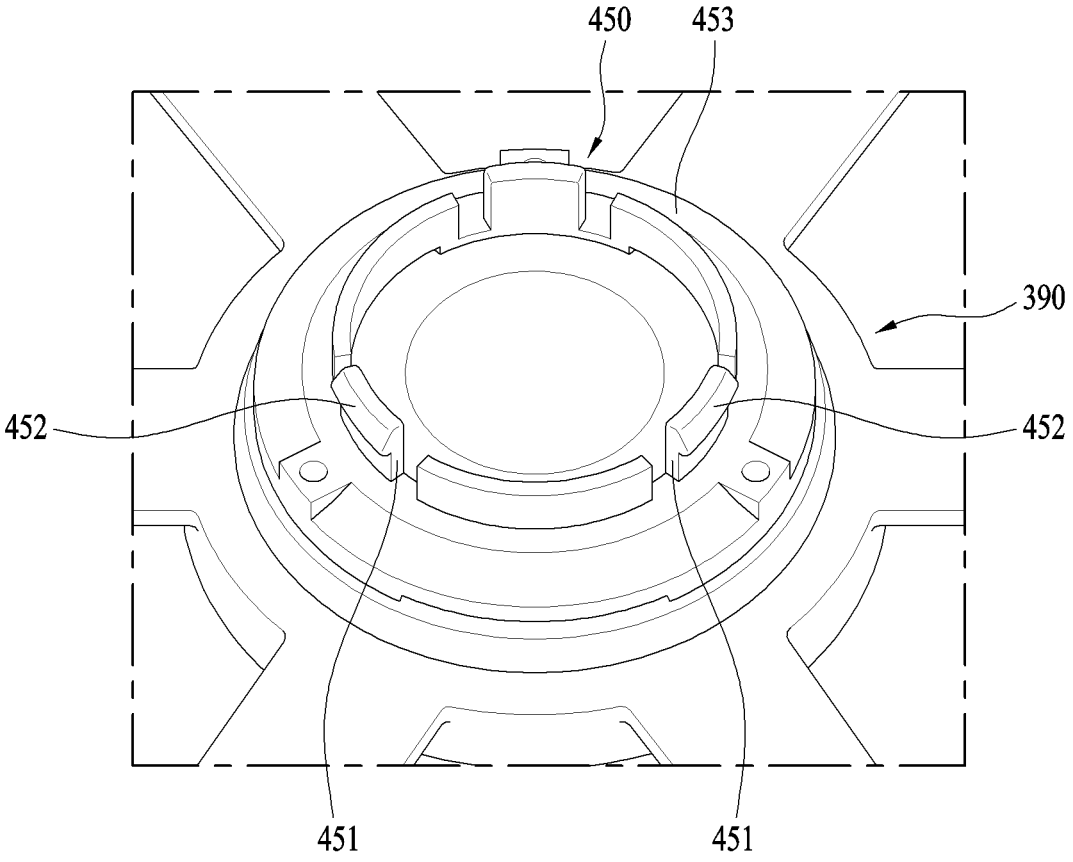
FIG. 7A is a perspective view illustrating an example of a coupled state between a hub and a pulsator connector.

Hereinafter, the structure in which the pulsator 400 is rotatably coupled to the pulsator connector 450 will be described with reference to FIGS. 7A and 7B. FIG. 7A illustrates an example coupled state between the hub and the pulsator connector, and FIG. 7B is illustrates the example coupled state between the pulsator connector and the pulsator.

Figure 7B:
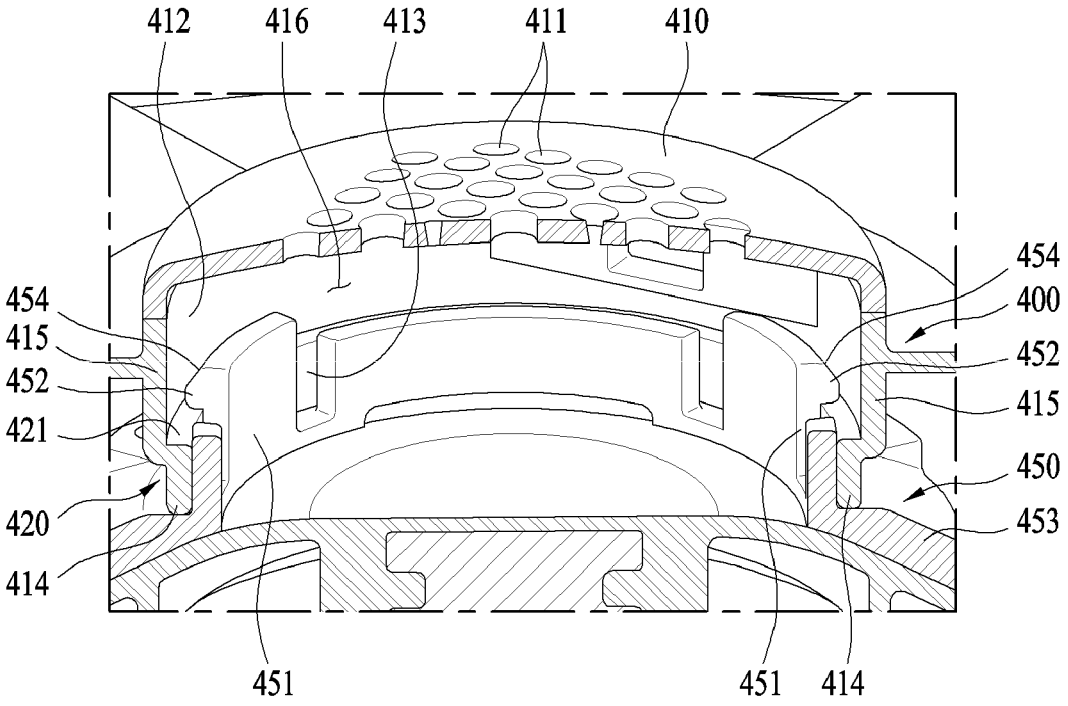
FIG. 7B is perspective cross-sectional view illustrating an example of a coupled state between the pulsator connector and a pulsator.

Referring to FIGS. 7A and 7B, the rotational force of the second motor 340 may be transferred to the hub 390 through the second shaft 341 connected to the second motor 340. The pulsator connector 450 may be coupled to the upper side of the hub 390. That is, the pulsator connector 450 may include a connector body 453, a vertical protrusion portion 451 which protrudes upward from the connector body 453, and a latch portion 452 which protrudes outward from the free end of the vertical protrusion portion 451. In some cases, the connector body 453, the vertical protrusion portion 451, and the latch portion 452 may be integrally formed.

The pulsator connector 450 may have a plurality of ribs protruding upward from the connector body 453, and at least a portion of the ribs may form the vertical protrusion portion 451. The vertical protrusion portion 451 may be configured as a plurality of vertical protrusion portions, and the vertical protrusion portions 451 may be spaced apart from each other by a predetermined distance (i.e. a predetermined angular distance). In addition, the latch portion 452, which protrudes laterally from the pulsator connector 450, may be provided at the free end of each vertical protrusion portion 451. For example, the latch portion 452 may be provided at the free end of the vertical protrusion portion 451, and may protrude toward the outer periphery of the pulsator connector 450.

In some cases, the pulsator 400 may be formed with the connection hole 416 for accommodating the vertical protrusion portion 451 of the pulsator connector 450. The connection hole 416 may vertically penetrate the pulsator 400. Specifically, the connection hole 416 may be formed in the central portion of the pulsator 400. In addition, the stepped portion 420 may be formed on the inner peripheral surface of the connection hole 416.

The stepped portion 420 may protrude such that the inner peripheral surface of the connection hole 416 has a decreasing diameter toward the center of the connection hole 416. In some cases, the inner peripheral surface of the connection hole 416 may be divided into a first inner peripheral surface 412, which is formed above the stepped portion 420, and a second inner peripheral surface 413 on which the stepped portion 420 is formed. That is, the inner peripheral surface of the stepped portion 420 may form the second inner peripheral surface 413. In this case, the second inner peripheral surface 413 may have a smaller diameter than that of the first inner peripheral surface 412, due to the stepped portion 420.

When the pulsator 400 is rotatably coupled to the pulsator connector 450, the vertical protrusion portion 451 of the pulsator connector 450 is inserted through the connection hole 416 formed in the pulsator 400. For example, the vertical protrusion portion 451 is inserted through the lower side of the connection hole 416, so that the pulsator 400 may be coupled to the pulsator connector 450. In addition, the holes 411 may be formed in the upper side of the connection hole 416 to be covered by the mesh cap 410 for performing a filtering function.

In this case, the latch portion 452 formed at the free end of the vertical protrusion portion 451 has an inclined surface 454, thereby enabling the vertical protrusion portion 451 to be inserted through the lower side of the connection hole 416. Specifically, the connection hole 416 is divided by an upper frame 415 and a lower frame 414, and the outer peripheral surface of the latch portion 452 has a larger diameter than that of the inner peripheral surface of the lower frame 414. For example, an upper frame 415 and a lower frame 414 dividing the connection hole 416 may be classified into the upper side and the lower side on the basis of the stepped portion 420. In addition, the inner peripheral surface of the upper frame 415 may have a larger diameter than that of the inner peripheral surface of the lower frame 414.

When the pulsator 400 is coupled to the pulsator connector 450, the lower frame 414 at the lower side of the connection hole 416 may slide along the guide surface of the latch portion 452 so that the vertical protrusion portion 451 and the latch portion 452 of the pulsator connector 450 are inserted into the connection hole 416. That is, when the pulsator 400 is coupled to the pulsator connector 450, the lower frame 414 at the lower side of the connection hole 416 may push the guide surface of the latch portion 452 toward the center of the connection hole 416 so that the vertical protrusion portion 451 and the latch portion 452 are inserted into the connection hole 416. In order to couple the pulsator 400 to the pulsator connector 450, the vertical protrusion portion 451 provided at the pulsator connector 450 may be made entirely or in part of a flexible material, for example plastic.

When the pulsator 400 is coupled to the pulsator connector 450, the latch portion 452 of the pulsator connector 450 may be engaged with the stepped portion 420 formed on the inner peripheral surface of the connection hole 416. Specifically, the latch portion 452 of the pulsator connector 450 may protrude toward the inner peripheral surface of the connection hole 416, and may be disposed on an upper portion 421 of the stepped portion 420. That is, the latch portion 452 may be caught by the upper surface 421 of the stepped portion 420. For example, the latch portion 452 may be arranged such that the lower surface of the latch portion 452 faces the upper surface 421 of the stepped portion 420. In addition, a predetermined gap may be defined between the latch portion 452 and the upper surface 421 of the stepped portion 420.

Accordingly, the pulsator connector 450 may restrict the vertical movement of the pulsator 400. For example, the connector body 453 of the pulsator connector 450 may restrict the downward movement of the pulsator 400, and the latch portion 452 of the pulsator connector 450 may restrict the upward movement of the pulsator 400.

The vertical protrusion portion 451 provided at the pulsator connector 450 may be configured as a plurality of vertical protrusion portions, and the vertical protrusion portions 451 may be spaced apart by a predetermined distance in the circumferential direction corresponding to the inner peripheral surface (i.e. the second inner peripheral surface) of the connection hole 416 formed in the pulsator 400.

In this case, since the latch portion 452 protrudes toward the inner peripheral surface of the connection hole 416 from the free end of each vertical protrusion portion 451, the outer peripheral surface of the vertical protrusion portion 451 may have a smaller diameter than that of the outer peripheral surface of the latch portion 452. In addition, the inner peripheral surface (i.e. the second inner peripheral surface) of the stepped portion 420 may have a larger diameter than that of the outer peripheral surface of the vertical protrusion portion 451. That is, a predetermined gap may be defined between the inner peripheral surface of the stepped portion 420 and the outer peripheral surface of the vertical protrusion portion 451. Through the gap defined between the inner peripheral surface of the stepped portion 420 and the outer peripheral surface of the vertical protrusion portion 451, it is possible to prevent or minimize friction caused between the inner peripheral surface of the stepped portion 420 and the outer peripheral surface of the vertical protrusion portion 451 when the pulsator 400 rotates about the pulsator connector 450.

The first inner peripheral surface 412 of the connection hole 416 may have a larger diameter than that of the outer peripheral surface of the latch portion 452. That is, a predetermined gap may be defined between the first inner peripheral surface 412 of the connection hole 416 and the outer peripheral surface of the latch portion 452. Through the gap defined between the first inner peripheral surface 412 of the connection hole 416 and the outer peripheral surface of the latch portion 452, it is possible to prevent or minimize friction caused between the first inner peripheral surface 412 of the connection hole 416 and the outer peripheral surface of the latch portion 452 when the pulsator 400 rotates about the pulsator connector 450.

As described above, it may be possible to prevent or minimize the friction, which is caused between the pulsator connector 450 and the pulsator 400 in the rotation direction of the pulsator 400 or in the direction opposite thereto, when the pulsator 400 rotates.

For instance, the vertical movement of the pulsator 400 may be restricted by the pulsator connector 450, but the pulsator 400 may rotate about the pulsator connector 450.

In other words, the driving force of the second motor 340 may not be transferred to the pulsator 400 even though the pulsator connector 450 is rotated by the driving of the second motor 340. The pulsator 400 may rotate due to friction with at least one of wash water and laundry, which are accommodated in the second drum 330 to rotate along with the rotation of the second drum 330.

In addition, the pulsator 400, which begins to rotate due to friction with at least one of wash water and laundry in the second drum 330, may continue to rotate for a predetermined time due to inertia even though the rotation of the second drum 330 is stopped. Similarly, the pulsator 400 may continue to rotate due to inertia even when the rotation direction of the second drum 330 is reversed.

The driving of the pulsator 400 will be described below in detail. When the second drum 330 is rotated by the second motor 340, the wash water and laundry accommodated in the second drum 330 rotate along with the rotation of the second drum 330 in the rotation direction of the second drum 330.

Friction may be generated between the wash water and laundry and the pulsator 400 which is freely and rotatably provided in the second drum 330, thereby enabling the pulsator 400 to also rotate in the rotation direction of the second drum 330. In addition, the pulsator 400 may continue to rotate for a predetermined time due to inertia even though the rotation of the second drum 300 is stopped. Thus, since the vortex of the wash water can be generated by the pulsator 400, it can be possible to prevent laundry from tangling and improve washing efficiency.

In order to improve washing efficiency, the second drum 330 may rotate in one direction for a predetermined time, and may then rotate in the other direction. In this case, even when the pulsator 400 rotates in one direction due to friction with at least one of wash water and laundry and the second drum 330 rotates in the other direction, the pulsator 400 may continue to rotate in the one direction for a predetermined time due to inertia.

In some cases, an interval may occur during which the second drum 330 and the pulsator 400 rotate in opposite directions. That is, the second drum 300 and the pulsator 400 may rotate in opposite directions for a predetermined time due to the inertia of rotation of the pulsator 400. In this case, since the vortex of the wash water is also generated by the pulsator 400, it may be possible to prevent laundry from tangling and improve the washing efficiency.

Furthermore, in accordance with the structure of the present disclosure, since there is no need for components such as the clutch which selectively transfers the driving force of the second motor 340 to the pulsator 400, the secondary washing device 300 can have a compact structure, compared to a washing device having a clutch. In addition, the manufacturing costs of the secondary washing device 300 can be reduced, and power consumption of the secondary washing device 300 may be reduced.

In accordance with the present disclosure, since additional components such as a clutch that selectively transfers the driving force of a motor to a drum and a pulsator may be omitted, a laundry treatment apparatus (particularly, a secondary washing device) can have a compact structure.

In addition, since the clutch is not required, the secondary washing device can have a simple structure compared to when having a clutch, and the overall manufacturing costs of the laundry treatment apparatus can be reduced.

In addition, since the motor provided in the secondary washing device rotates only the drum of the secondary washing device, power consumption may be reduced compared to the case where the drum and the pulsator are driven together by a single motor.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A laundry treatment apparatus comprising:

a tub configured to receive wash water;

a drum rotatably provided in the tub and configured to receive laundry;

a pulsator rotatably provided in the drum and configured to be rotated relative to the drum by motion of one or both of the wash water and the laundry that are received in the drum, the pulsator defining a connection hole in a central portion of the pulsator;

a motor configured to rotate the drum;

a shaft configured to be rotated by the motor;

a hub connected to one end of the shaft and configured to rotate together with the shaft, the hub being located below the drum and configured to be coupled to a bottom surface of the drum; and a pulsator connector that is located on an upper surface of the hub, that supports the pulsator, and that allows the pulsator to freely rotate regardless of rotation of the shaft, wherein based on the shaft rotating at a rotational speed, the hub and the drum are configured to rotate at the rotational speed of the shaft, wherein the pulsator is configured to, based on motion of one or both of wash water and laundry that are received in the drum, rotate independently of rotation of the shaft, wherein the pulsator connector comprises:

a connector body that faces the upper surface of the hub, and a vertical protrusion portion that extends upward from the connector body toward the pulsator and that defines a connector hole that is located at a central region of the pulsator connector and that is in communication with the connection hole of the pulsator, wherein the vertical protrusion portion of the pulsator connector comprises a plurality of vertical protrusion portions that are spaced apart from one another to define one or more slits that allow flow of wash water through the connector hole and that extend along a circumference of the connector body, and wherein the plurality of vertical protrusion portions comprise inner surfaces that surround and face the connector hole of the pulsator connector.

2. The laundry treatment apparatus according to claim 1, wherein the pulsator is configured to, based on the rotation of the drum stopping after a period of rotation, continue rotating in the same direction as the previous rotation direction of the drum for a predetermined time due to inertia.

3. The laundry treatment apparatus according to claim 1, wherein the pulsator is restricted from vertically moving in the drum.

4. The laundry treatment apparatus according to claim 3, wherein:

the pulsator comprises a stepped portion that is located at an inner peripheral surface of the connection hole; and the vertical protrusion portion forms a rotary shaft of the pulsator, and the pulsator connector further comprises a latch portion configured to be engaged with the stepped portion to restrict vertical movement of the pulsator.

5. The laundry treatment apparatus according to claim 4, wherein the stepped portion is configured such that the inner peripheral surface of the connection hole has a decreasing diameter toward a center of the connection hole.

6. The laundry treatment apparatus according to claim 4, wherein:

the latch portion is fastened to an upper surface of the stepped portion; and a predetermined gap is defined between the latch portion and the upper surface of the stepped portion.

7. The laundry treatment apparatus according to claim 4, wherein the latch portion is configured as one or more latch portions provided along the inner peripheral surface of the connection hole.

8. The laundry treatment apparatus according to claim 4, wherein:

a mesh cap is provided at an upper side of the connection hole; and the mesh cap defines a plurality of holes having a predetermined size, the plurality of holes being configured to perform a filtering function.

9. The laundry treatment apparatus according to claim 1, wherein the pulsator comprises a body rotatably provided on the bottom surface of the drum, and one or more blades protruding upward from the body.

10. The laundry treatment apparatus according to claim 9, wherein:

the blades extend outward from a center of the body; and the body and blades of the pulsator are integrated with each other.

11. The laundry treatment apparatus according to claim 1, comprising a main washing device and a secondary washing device, wherein the tub, the drum, and the pulsator are provided in the secondary washing device of the laundry treatment apparatus, and wherein the secondary washing device is a drawer type washing device configured to be inserted in and withdrawn from the laundry treatment apparatus.

12. The laundry treatment apparatus according to claim 11, further comprising a first cabinet defining an external appearance of the main washing device and a second cabinet defining an external appearance of the secondary washing device.

13. The laundry treatment apparatus according to claim 12, wherein the first and second cabinets are integrated with each other.

14. The laundry treatment apparatus according to claim 1, wherein the pulsator connector is directly attached to the upper surface of the hub, and the hub is coupled to the one end of the shaft.

15. The laundry treatment apparatus according to claim 1, further comprising a connection flange that couples the hub to the bottom surface of the drum and is configured to directly transfer driving force of the motor from the hub to the bottom surface of the drum.

16. The laundry treatment apparatus according to claim 1, wherein the plurality of vertical protrusion portions comprise:

a first vertical protrusion that extends along the circumference of the connector body; and a second vertical protrusion that is spaced apart from the first vertical protrusion and that extends along the circumference of the connector body, wherein a first perimeter of the first vertical protrusion along the connector body is longer than a second perimeter of the second vertical protrusion along the connector body, and wherein the pulsator connector further comprises a latch portion that protrudes radially outward from the second vertical protrusion and that is configured to, based on engaging with the pulsator, restrict vertical movement of the pulsator.

17. A washing device for treating laundry that is configured to be placed under a laundry treatment apparatus, wherein the washing device comprises:

a tub configured to receive wash water;

a drum rotatably provided in the tub and configured to receive laundry;

a pulsator rotatably provided in the drum and configured to be rotated relative to the drum by motion of one or both of the wash water and the laundry that are received in the drum, the pulsator defining a connection hole in a central portion of the pulsator;

a motor configured to rotate the drum;

a shaft configured to be rotated by the motor;

a hub connected to one end of the shaft and configured to rotate together with the shaft, the hub being located below the drum and configured to be coupled to a bottom surface of the drum; and a pulsator connector that is located on an upper surface of the hub, that supports the hub, and that allows the pulsator to freely rotate regardless of rotation of the shaft, wherein based on the shaft rotating at a rotational speed, the hub and the drum are configured to rotate at the rotational speed of the shaft, wherein the pulsator is configured to, based on based on motion of one or both of wash water and laundry that are received in the drum, rotate independently of rotation of the shaft, wherein the pulsator connector comprises:

a connector body that faces the upper surface of the hub, and a vertical protrusion portion that extends upward from the connector body toward the pulsator and that defines a connector hole that is located at a central region of the pulsator connector and that is in communication with the connection hole of the pulsator, wherein the vertical protrusion portion of the pulsator connector comprises a plurality of vertical protrusion portions that are spaced apart from one another to define one or more slits that allow flow of wash water through the connector hole and that extend along a circumference of the connector body, and wherein the plurality of vertical protrusion portions comprise inner surfaces that surround and face the connector hole of the pulsator connector.

18. The washing device according to claim 17, wherein the pulsator is configured to, based on the rotation of the drum stopping after a period of rotation, continue rotating in the same direction as the previous rotation direction of the drum for a predetermined time due to inertia.

19. The washing device according to claim 17, wherein the pulsator comprises a body rotatably provided on the bottom surface of the drum, and one or more blades protruding upward from the body.

* * * * *